US005567202A

United States Patent [19]

Hager

[11] Patent Number: 5,567,202

[45] Date of Patent: Oct. 22, 1996

[54] FITNESS DEVICE

[76] Inventor: Kathleen Hager, 25 Putnam Rd., Courtland Manor, N.Y. 10566

[21] Appl. No.: 370,130

[22] Filed: Jan. 9, 1995

[51] Int. Cl.[6] ..... A63B 21/00

[52] U.S. Cl. ..... 482/131; 482/140; 482/907

[58] Field of Search ..... 482/907, 140, 482/91, 131

[56] References Cited

U.S. PATENT DOCUMENTS

| | | | |
|---|---|---|---|
| 4,815,732 | 3/1989 | Mahvi | 482/907 |
| 4,819,936 | 4/1989 | Muller | 482/907 |
| 4,844,453 | 7/1989 | Hestilow | 482/907 |

OTHER PUBLICATIONS

Flexmaster Advertisement, Sep. 1987.

*Primary Examiner*—Lynne A. Reichard
*Attorney, Agent, or Firm*—Handal & Morofsky

[57] ABSTRACT

A fitness device is disclosed. A first contracting member is provided for contacting the back of a user. A second contacting member is provided for contacting the legs of the user. The first contacting member is pivotable relative to the second contacting member. A user-operable lever pivots the first contacting member so that in use, the back of the user is applied a pressure by the pivoting first contacting member so that the chest of the user is urged toward the legs of the user. Thus the user bends at the waist in response to the operation of the lever, and the back and leg muscles of the user are stretched. The inventive fitness device is constructed so as to fold up for easy storage and shipping. Also, a user-operated position locking mechanism maintains the position of the pivoted first contacting member so that an adequate stretch can be applied to the back and legs of the user.

21 Claims, 26 Drawing Sheets

FITNESS DEVICE

TECHNICAL FIELD

The present invention relates to a fitness device. More particularly, the present invention pertains to a fitness device for stretching the lower back and legs of a user.

BACKGROUND

At least 100 million workdays are lost each year to lower back injuries at a cost to employers of $20 billion. It has been estimated that workers compensation claims for back problems total $8.75 billion a year. Exercise professionals know back pain and injury can be prevented through appropriate strengthening and stretching exercises.

Most athletes (both professional and recreational) know that in order to perform at their best level physically, it is necessary to warm up the body's muscles prior to performing an exercise. Also, to maintain muscle tone and flexibility, it is important to stretch one's muscles by exerting an elongating pulling force acting on the particular muscles being stretched. Typically, muscle stretching is performed by assuming a position in which a particular muscle group is elongated. This position is held for a period of time and then additional force is applied to further elongate the isolated muscle group.

When performing muscle stretching exercises, an athlete will typically concentrate stretching exercises that are designed to apply the elongating pulling force on the relatively larger muscle groups of the body, such as the muscle groups located in the legs and back. A common stretching procedure used to stretch the hamstring and lower back muscles is to stand straight up and then bend at the waist, while keeping the legs straight. The action of bending the torso at the waist exerts the desired pulling force on the muscles of the legs and back, and in particular, on the hamstring muscles. Since the hamstring muscles are one of the largest muscle groups of the body, used when performing many types of exercises and are commonly injured, it very important to insure that the hamstring muscles of the legs receive an adequate stretching prior to, and after, exercising.

However, the traditional methods used for stretching the leg muscles and back muscles are inefficient, and place the athlete at a high risk of lower back injury. For example, when performing the above described stretching exercise where the torso is bent at the waist, the entire weight of the upper body is supported by the muscles of the lower back. This places a tremendous strain on a group of muscles that tend to be weak and very tight in most individuals. Very often the back muscles are overloaded when a stretching exercise is performed, causing muscle fibers to tear, and resulting in debilitating pain and injury.

In order to provide a better stretch of the leg muscles and back muscles, another stretching method requires the athlete to sit with the back of the thighs flat on the ground and toes of the feet pointing up. The athlete then reaches slowly forward with his hands towards his feet to bend the torso at the waist and perform the stretching exercise. A limber athlete will, in this position, be able to grab his feet with his hands and pull his chest towards his feet. In order to get a more consistent and more effective stretch, an assistant can apply an urging force to the back and shoulders of the athlete to urge the chest towards the feet. It is important for the assistant to exert enough of a force at an appropriate rate in order to obtain a good stretch of muscles, without causing pain or damage to the athlete. Typically, the athlete will communicate to the assistant how much pressure to apply and when to stop. In another method, which isolates the hamstring muscles from the lower back muscle (which is essential in some rehabilitation programs), the individual lies on his back and places one leg straight up in the air. Typically a towel or band is placed around the foot so as to apply a force pulling the leg toward the chest.

With both of the described methods, not only is a force applied by the assistant, but a counter force is applied by the athlete. This counter force is timed and released. As the counter force is released, the assistant is able to move further into the stretch. This stretching technique is referred to as PNF (proprio-neuro-facilitation) and is extensively used by rehabilitation professionals with tremendous results. An assistant is very beneficial when performing either of these stretching methods.

The traditional methods for stretching the legs and the back of an athlete are inadequate. It is difficult for an athlete to exert enough of an urging force without resorting to the dangerous bouncing motion. Also, even if an athlete is fortunate enough to have an assistant on hand to exert a consistent and adequate urging force, it is still difficult to obtain a good stretch, since the athlete must communicate with the assistant precisely when enough force is being applied, and how long to apply the force. If not enough force is applied, then the muscles do not receive an adequate stretch. If too much force is applied, then the athlete runs the risk of serious muscle and connecting tissue damage. Therefore, there is a need for a fitness device that an athlete can use alone for exerting and maintaining an appropriate force for both stretches described above. Since prevention and treatment for lower back and hamstring injuries involves obtaining increased flexibility or elongation of the muscles in this area, a device such as the present invention would have wide spread use among rehabilitation professionals as well as any commercial fitness facility.

SUMMARY OF THE INVENTION

The present invention is intended to provide a remedy. It is an object of the present invention to overcome the drawbacks of the traditional muscle stretching methods, and provide a simple to use fitness device that can be used by all individuals embarking on a fitness program. It is another object of the present invention to provide such a fitness device using a simple construction and common materials to keep manufacturing costs low. It is another object of the present invention to provide such a fitness device capable of indicating to the user the progress and improvement in the flexibility of the lower back and hamstring muscles of the user due to the use of the inventive fitness device.

In accordance with the present invention, a fitness device for use by a user having a back, legs, a torso, a waist, and a chest is provided. A first contacting member is provided for contacting the back of the user. A second contacting member is provided for contacting the legs of the user. An end of the first contacting member and an end of the second contacting member are pivotally connected so that the first contacting member is pivotable relative to the second contacting member. Thus, in accordance with the present invention, in an initial position, the first contacting member and the second contacting member define a first angle for accommodating the user. The user disposes himself so as to have the back contacting the first contacting member and the legs contacting the second contacting member so that the torso and the legs of the user define substantially the first angle. A lever, operable by the user, urges the first contacting member to pivot relative to the second contacting member, to define a second angle. Thus, the first contacting member applies pressure to the back of the user to urge the chest toward the legs, so that the torso of the user bends at the waist, and the chest is urged toward the legs. The user grabs the lever, and pushes the lever forward, with an appropriate force so that the legs and back of the user are properly stretched.

Also, in accordance with the present invention, the position of the first contacting member relative to the position to the second contacting member can be locked, so that the urging force is maintained against the back of the user to urge the chest toward the feet to obtain a good stretch to the leg muscles and back muscles, and in particular, to the hamstrings. This lock also allows the user to apply counter force on the first and second contacting. Once this force is steadily increased, the lever can be clicked further to maintain the increased muscle length obtained through counter pressure.

To lock the position of the first member relative to the second member, a toothed wheel is rotatable by the first contacting member, when the first contacting member pivots. A pawl engages with the tooth wheel, so that in an engaged position, the first contacting member is pivotable only in a direction allowing the chest to be urged toward the legs (to maintain adequate pressure against the back). The pawl is operably disengagable from the tooth wheel by the user, so that the first contacting member can pivot in the opposite direction, allowing the chest to move away from the legs, thereby relieving the stretching force from the user's muscles. A second position is where the user lies down on the unit with his legs placed up in the air, The lever is used to pull legs down toward the chest of the user and locked in place so that a counter force can be applied.

Furthermore, in accordance with the present invention, a bar extends from the second contacting member at a location toward the user's feet, and can be pulled by the arms of the user to urge the chest toward the legs. The position of the bar can be altered, to accommodate users of different height and fitness level. Also, the inventive fitness device can be folded up so as to take up little space, for easy storage.

BRIEF DESCRIPTION OF THE DRAWINGS

Embodiments of the invention are described in detail below with reference to drawings which illustrates specific embodiments of the invention and in which:

FIG. 3(*b*) is a side view of the inventive fitness device in use showing a muscle stretching position;

FIG. 3(*c*) is a side view of the inventive fitness device in use showing a final stretching position;

FIG. 3(*d*) is a side view of the inventive fitness device during an alternative method of use;

FIG. 4(*b*) is a side view of the inventive fitness device during a later stage of the folding operation shown in FIG. 4(*a*);

FIG. 4(*c*) is a side view of the folded inventive fitness device for easy storage;

FIG. 5(*b*) is an isolated enlarged side view of the essential components of the inventive fitness device shown in FIG. 5(*a*), shown in use;

FIG. 5(*c*) is an isolated enlarged side view of the essential components of the inventive exercise device shown in FIG. 5(*a*), shown in a folded position;

FIG. 6(*b*) is an isolated enlarged side view of the position locking components of the inventive fitness device shown in FIG. 6(*a*), shown in a non-locking position;

FIG. 6(*c*) is an isolated enlarged side view of the position locking components of the inventive exercise fitness device shown in FIG. 6(*a*), shown in a muscle stretching locked position;

FIG. 9(*b*) is a side view of the inventive fitness device shown in FIG. 9(*a*), shown in an extended position;

FIG. 10(*b*) is a side view of the alternative configuration of the inventive fitness device during the other alternative method of use shown in FIG. 10(*a*);

FIG. 10(*c*) is a side view of alternative configuration of the inventive fitness device during the other alternative method of use shown in FIG. 10(*a*);

FIG. 11(*b*) is an isolated cutaway back plan view of the split contacting surfaces shown in FIG. 11(*a*);

FIG. 11(*c*) is a side view of the inventive fitness device shown in FIG. 11(*a*), shown in use; and FIG. 11(*d*) is a side view of the inventive fitness device shown in FIG. 11(*a*), shown in use.

BEST MODE FOR CARRYING OUT THE INVENTION

Figure 1:
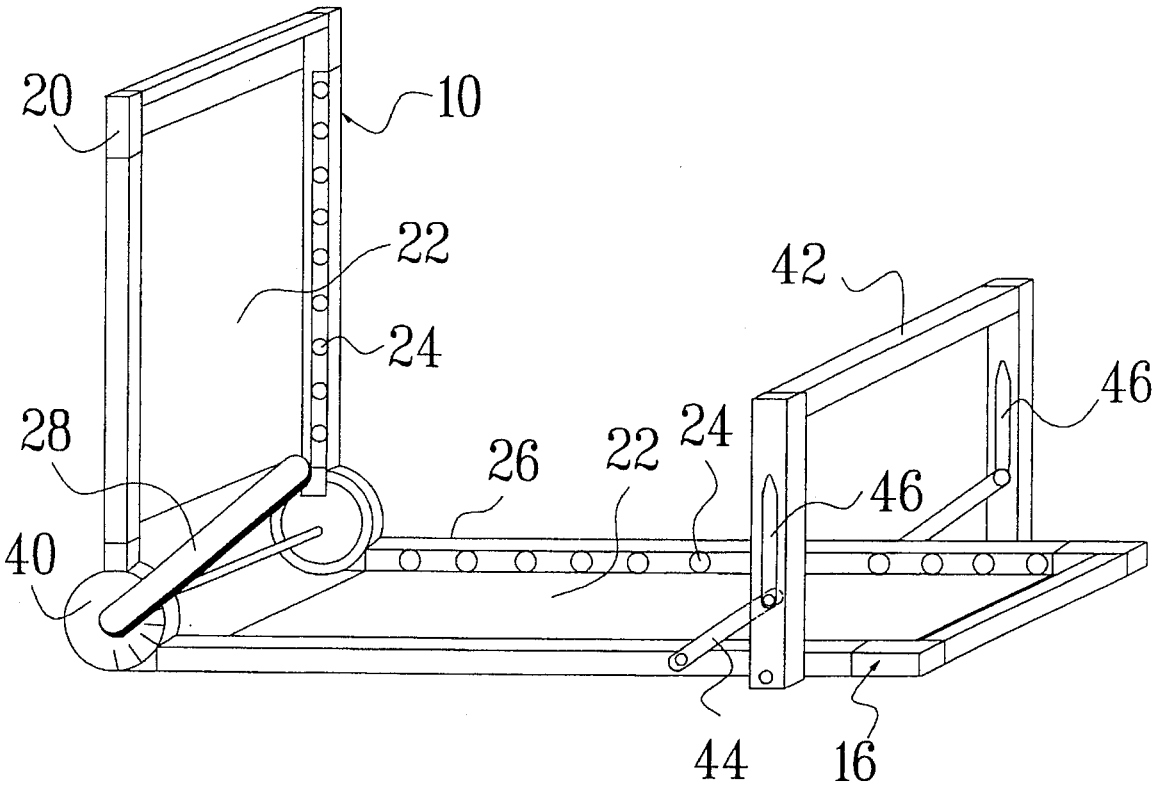
FIG. 1 is a perspective view of an embodiment of the fitness device in accordance with the present invention.

FIG. 1 shows a perspective view of an embodiment of the fitness device in accordance with the present invention. The inventive fitness device has been designed so that a user can obtain a safe and effective stretch to particular muscles (back and legs), without requiring the help of an assistant. The inventive fitness device allows a user to apply and maintain an appropriate urging force for driving his chest toward his feet so that the torso bends at the waist, and the back and leg muscles are adequately stretched, and also to apply a counter force to produce a greater elongation of the isolated muscle.

As shown in FIGS. 1 and 3(*a*), a first contacting member 10 is provided for contacting at least a portion of the back 12 of the user 14. A second contacting member 16 contacts the legs 18 of the user 14. The first contacting member 10 comprises a back frame 20 which supports a durable contacting surface, such as vinyl covered padded panels of wood. The contacting surface 22 is secured to the back frame 20 by screws 24, or other securing devices. The second contacting member 16 comprises a seat frame 26, which supports another contacting surface 22 that is fixed the seat frame 26 by screws 24, or other securing devices.

Alternatively, the first contacting member 10 and/or the second contacting member 16 may be constructed of a solid sheet of a suitable material, such as plastic, wood or metal. However, in accordance with the embodiment shown in FIG. 1, an easy to manufacture and light-weight construction is obtained for the inventive fitness device. The back frame 20 and the seat frame 26 may be constructed from metal tubing, plastic tubing or wood. Preferably, aluminum tubing is used. The first contacting member 10 is pivotally connected with the second contacting member 16. In use, a lever 28 is used to urge the first contacting member 10 to pivot relative to the second contacting member 16, so that the torso 30 of the user 14 bends at the waist 32, and the chest 34 of the user 10 is urged toward to legs 18, thereby enabling stretching of the muscles of the back 12 and legs 18.

Figure 2:
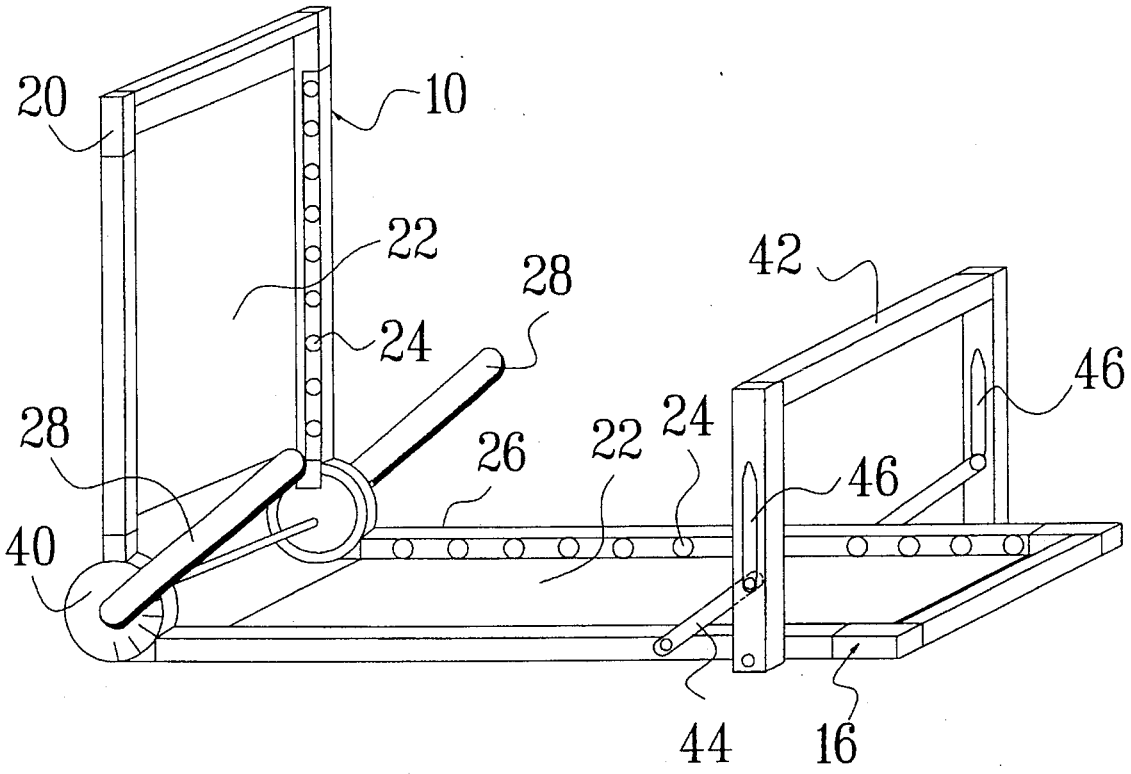
FIG. 2 is a perspective view of another embodiment of the fitness device in accordance with the present invention.
Figure 3A:
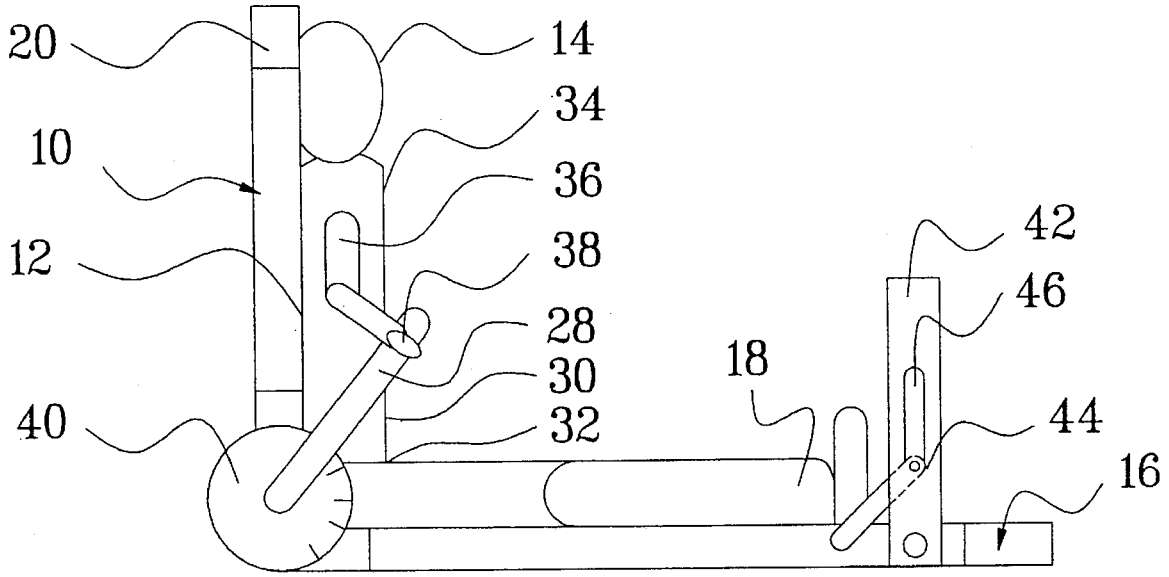
FIG. 3(*a*) is a side view of the inventive fitness device in use at an initial position.
Figure 3B:
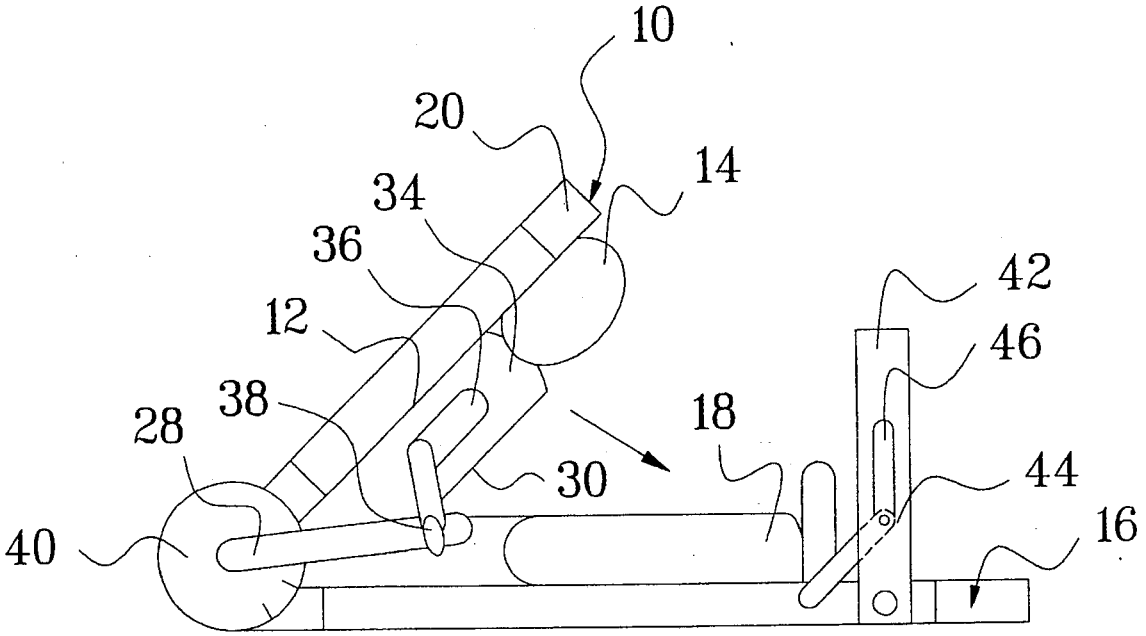
Figure 3C:
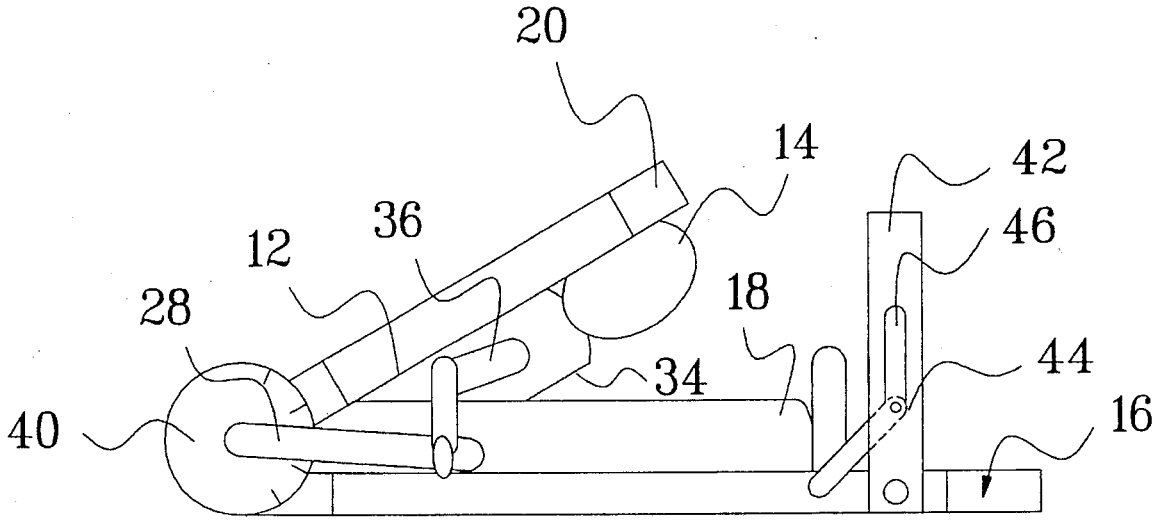
Figure 3D:
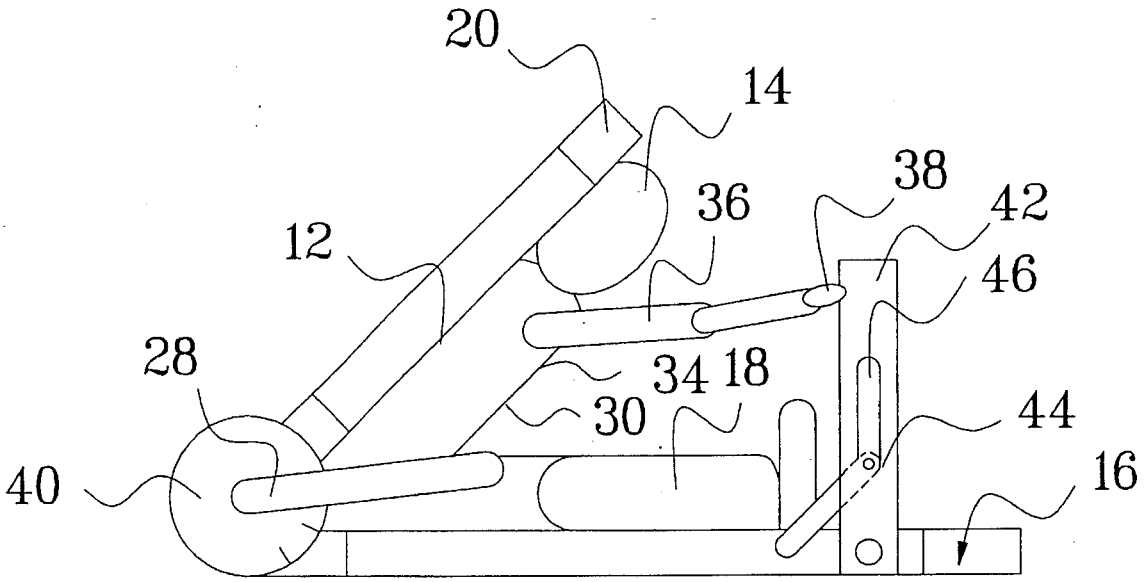

FIG. 2 shows an alternative embodiment of the inventive fitness device, in which a pair of levers 28 are used for urging the first contacting member 10 to pivot relative to the second contacting member 16. Each lever 28 is operable by an arm 36 of the user 14 (FIG. 3(*b*)), so that an even and consistent urging force is applied to affect the stretching exercise in accordance with the use of the inventive fitness device.

FIGS. 3(*a*)–3(*c*) show the intended use for the fitness device. As shown, with reference to FIG. 3(*a*), the user 14 sits with his legs 18 in contact with second contacting member 16, and his back 12 in contact with the first contacting member 10. The user 14 grabs the lever 28 with his hand 38 so that the lever 28 can be operated by movement of the arm 36. An indicating dial 40 is provided for displaying the position of the back frame 20, so that the user 14 can determine his progress while performing the stretching exercise. Preferably, the indicating dial 40 is calibrated in degrees, to give the user 14 an easily understood indication of his muscular flexibility. In the initial position shown in FIG. 3(*a*), the first contacting member 10 and the second contacting member 16 define a first angle. The user 14 is disposed so as to have his back 12 contacting the first contacting member 10 and, and his legs 18 contacting the second contacting member 16, with the torso 20 and the legs 18 defining substantially the first angle. As shown in FIG. 3(*b*), during use the user 14 operates the lever 26 to urge the first contacting member 10 to pivot relative to the second contacting member 16, to define a second angle. Thus, the first contacting member 10 applies pressure to the back 12 of the user to urge his chest 34 toward his legs 18, thereby performing the stretching exercise. As shown in FIG. 3(*c*), a particularly limber user 14 may be able to urge his chest 34 into contact with his legs 18, thereby obtaining the maximum possible stretch for the hamstring muscles. Since the urging force is applied directly by the user 14 through the lever 28, or levers 28, the user 14 is in complete control of the applied force exerted for stretching his muscles. Also, the lever 28 provides a mechanical advantage so that the user 14 is able to apply enough force to adequately stretch the large muscle groups of the back 12 and legs 18. In addition, the user 14 can apply a constant force, thereby avoiding the dangerous bouncing motion which typically occurs during conventional stretching exercises.

As shown in FIG. 3(*d*) in accordance with the present invention, a bar member 42 extends from the seat frame 26 of the second contacting member 16. The bar member 42 is pulled by the arms 36 of the user 14 to urge the chest 34 towards the legs 18, which also helps stretch out the muscles of the upper back 12, chest 34 and arms 36.

Figure 4A:
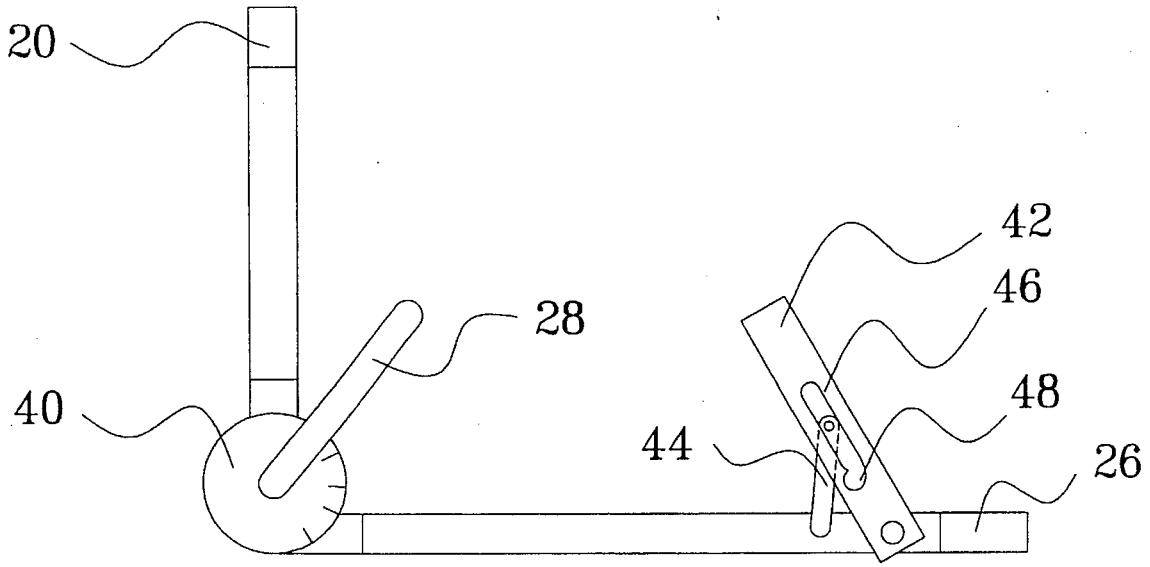
FIG. 4(*a*) is a side view of the inventive fitness device during a folding operation.
Figure 4B:
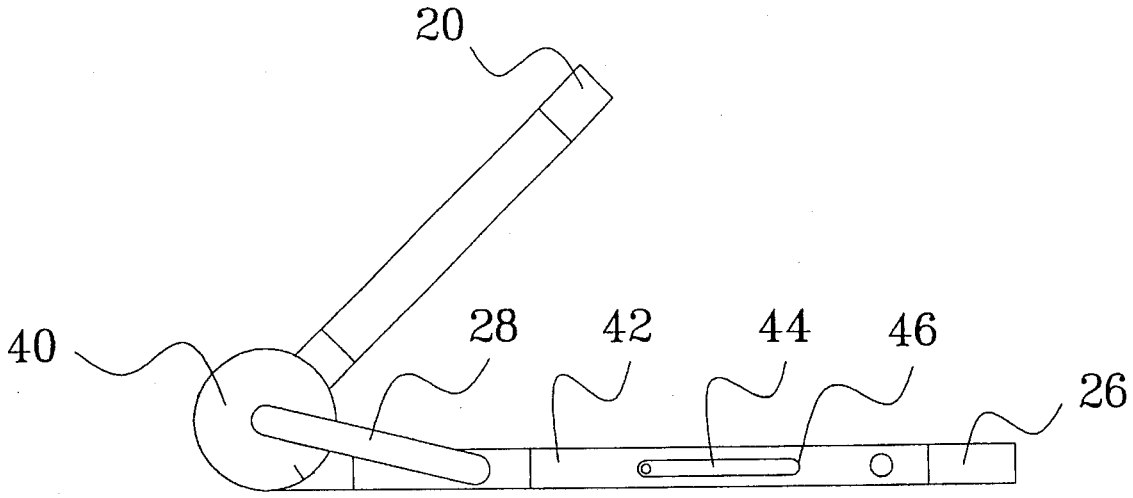
Figure 4C:
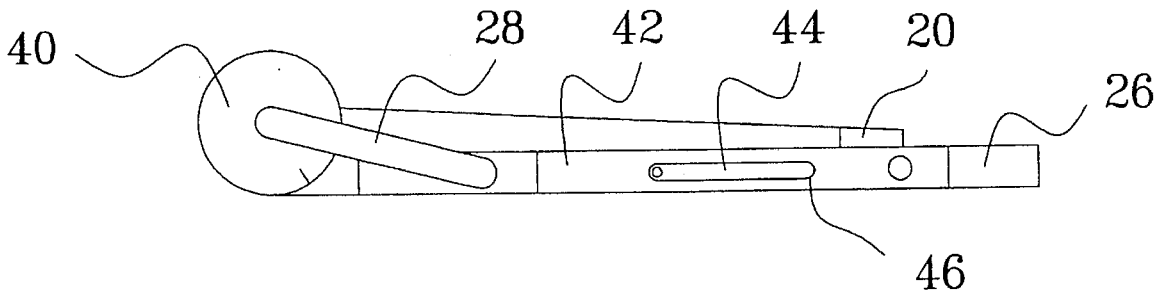

As shown in FIGS. 4(*a*)–4(*c*), the inventive fitness device can be easily folded into a very compact size for easy shipment and storage. To add further stability and strength to the inventive fitness device, the bar member 42 may be supported by a support member 44. The support member 44 is pivotally fixed to the seat frame 26 at one end, and slideably fixed in a receiving groove 46 of the bar member 42 at the other end. Thus, as shown in FIGS. 4(*a*) and 4(*b*), the bar member 42 can be folded substantially flat against the seat frame 26 as the support member 44 pivots and slides to allow the bar member 42 to pivot. As shown in FIG. 4(*a*), the receiving groove 46 of the bar member 42 terminates in a retaining surface 48 which retains the support member 44 at a position which allows the bar member 42 to be perpendicular with seat frame 26 during use. During the folding operation, the support member 44 is released from the retaining surface 48 and slides within the receiving groove 46 to allow the bar member 42 to fold down. As shown in FIG. 4(*b*), the back frame 20 and the lever 28 fold down toward the seat frame 26. However, as shown in FIGS. 4(*b*) and 4(*c*), in order for the lever 28 to be disposed at an appropriate position for accommodating the arm 36, it reaches its folded position sooner than the back frame 20 reaches its folded position. Therefor, in accordance with the inventive fitness device, the lever 28 is engaged with the back frame 20 to pivotally move the back frame 20 up to the point at which the lever 28 is disposed at its folded position. Then the lever 28 stops moving the back frame 20, but the back frame 20 can be manually moved to its folded position, shown in FIG. 4(*c*).

Figure 5A:
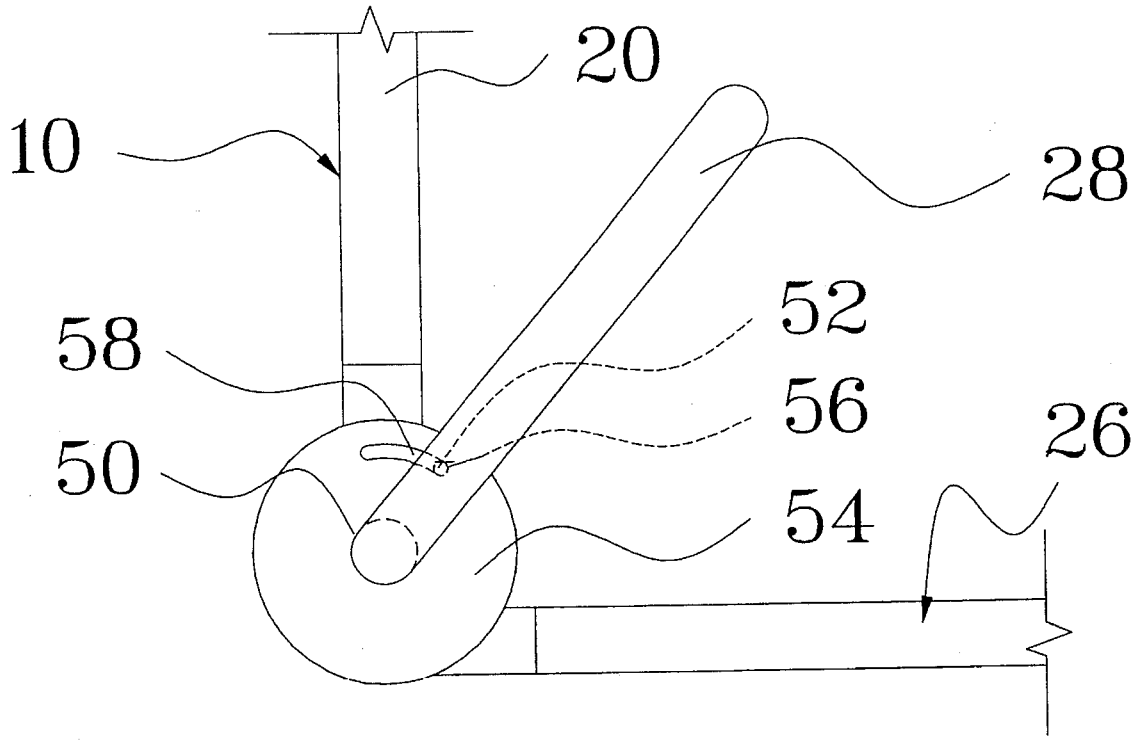
FIG. 5(*a*) is an isolated enlarged side view of essential components of the inventive fitness device during use.
Figure 5B:
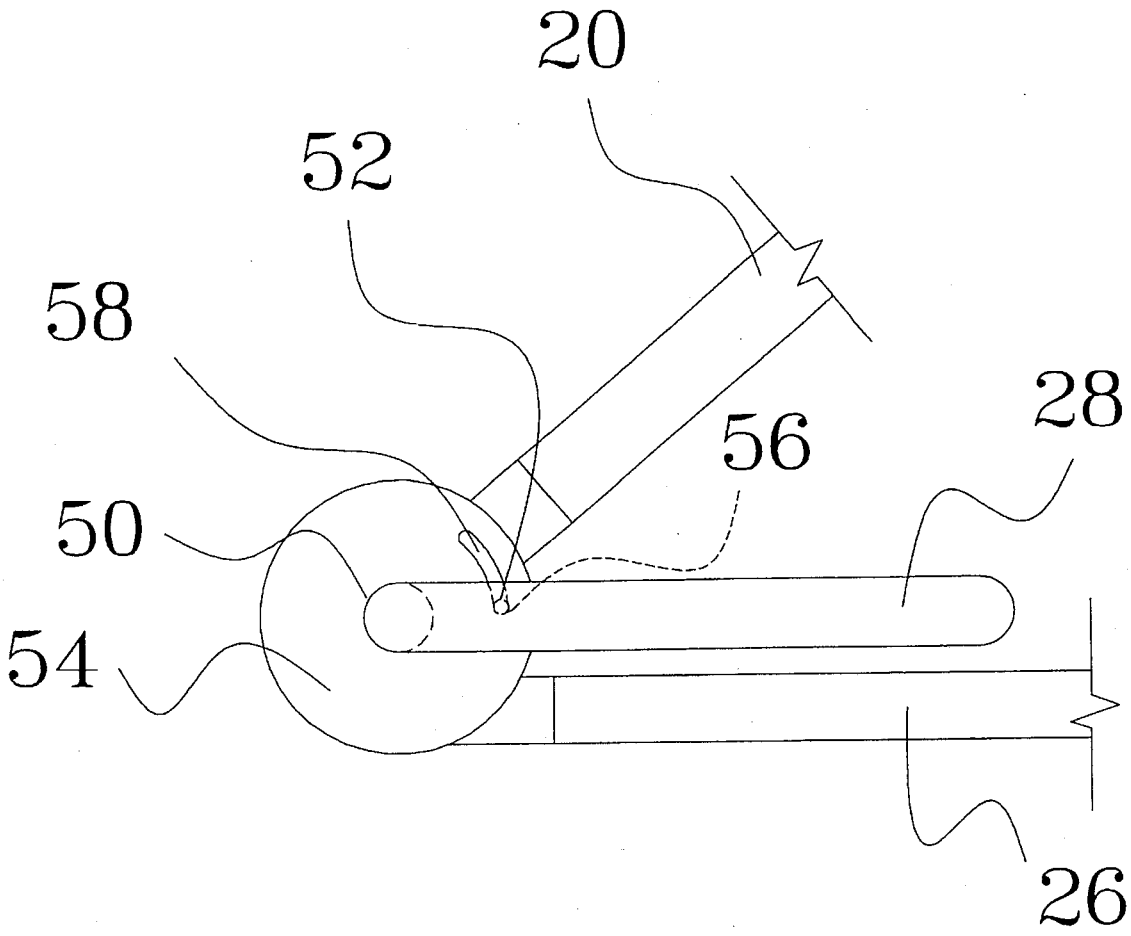
Figure 5C:
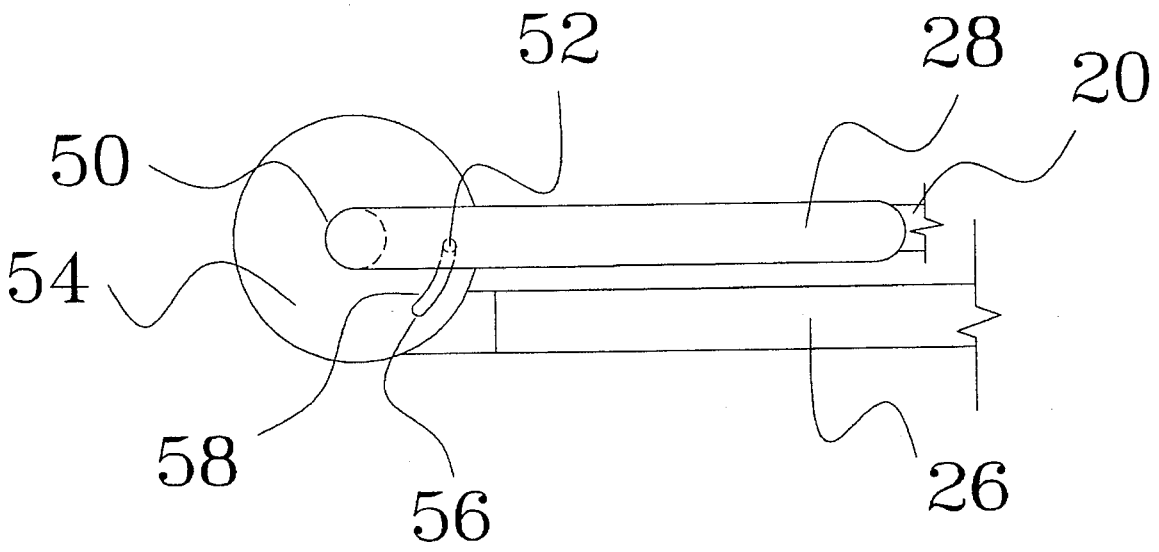

An embodiment of the inventive engagement between the lever 28 and the backframe 20, which allows the lever 28 to be positioned at its folded position and the backframe to be positioned at its folded position, is shown in FIGS. 5(*a*)–5(*c*). As shown, in accordance with the inventive fitness device, the urging means for urging the first contacting member 10 includes the lever 28, which is pivotable around an axle 50. A protruding member 52 is fixed to the lever 28. A driving member 54 is fixed with the first contacting member 10 and is also rotatable about the axle 50. The driving member 54 has a driving surface 56, and defines a receiving groove 58, which terminates at the driving surface 56. The receiving groove 58 receives the protruding member 52 so that the lever 28, being operable by the user 14, moves the protruding member 52 against the driving surface 55 to rotate the driving member 54 about the axle 50, for urging the first contacting member 10 to pivot relative to the second contacting member 16. By thus pivoting the first contacting member 10, the user 14 is able to urge his chest 34 toward his legs 18, to thereby stretch the muscles as desired. As shown in FIGS. 5(*b*) and 5(*c*), the receiving groove 58 is dimensioned to allow the driving member 54 to rotate a pre-determined amount without the lever 28 being pivoted. Thus, once the lever 28 reaches its folded position, the protruding member 52 slides within the receiving groove 58 as the back frame 20 is brought to its folded position allowing the inventive exercise device to be disposed in a compact folded position for easy shipping and storage.

Figure 6A:
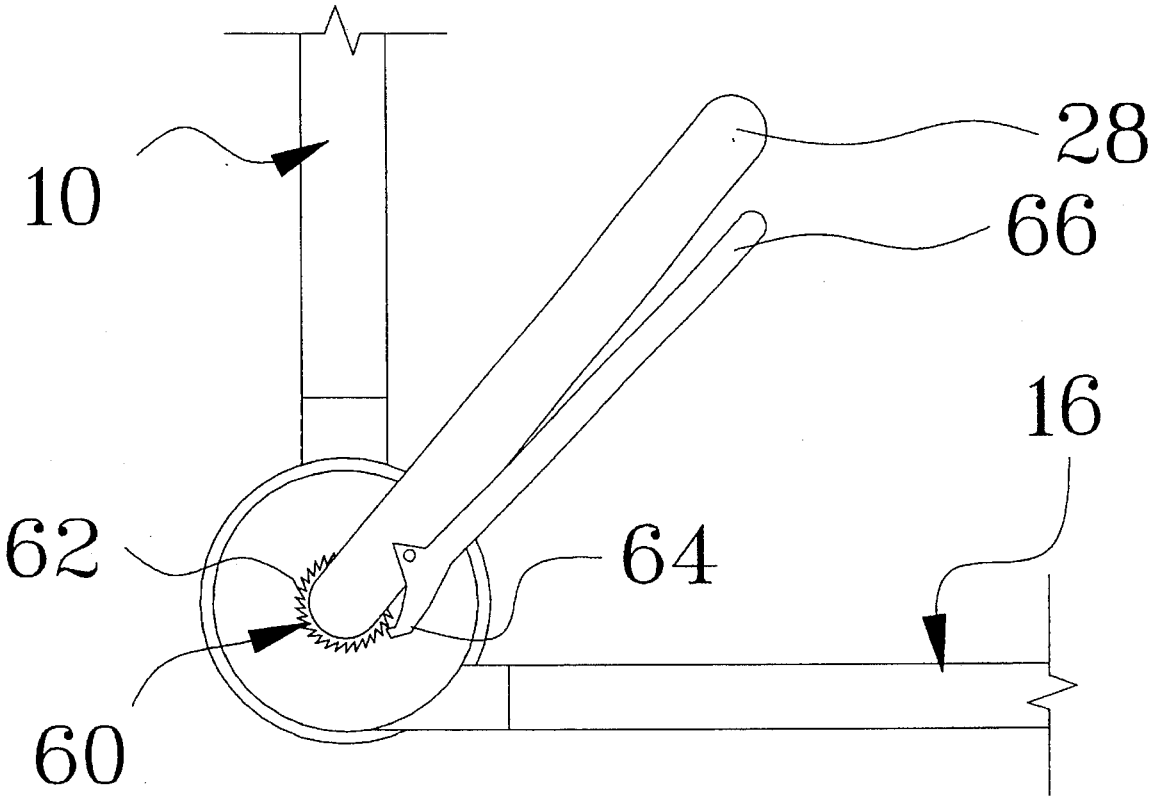
FIG. 6(*a*) is an isolated enlarged side view of the position locking components of the inventive fitness device at an initial position.
Figure 6B:
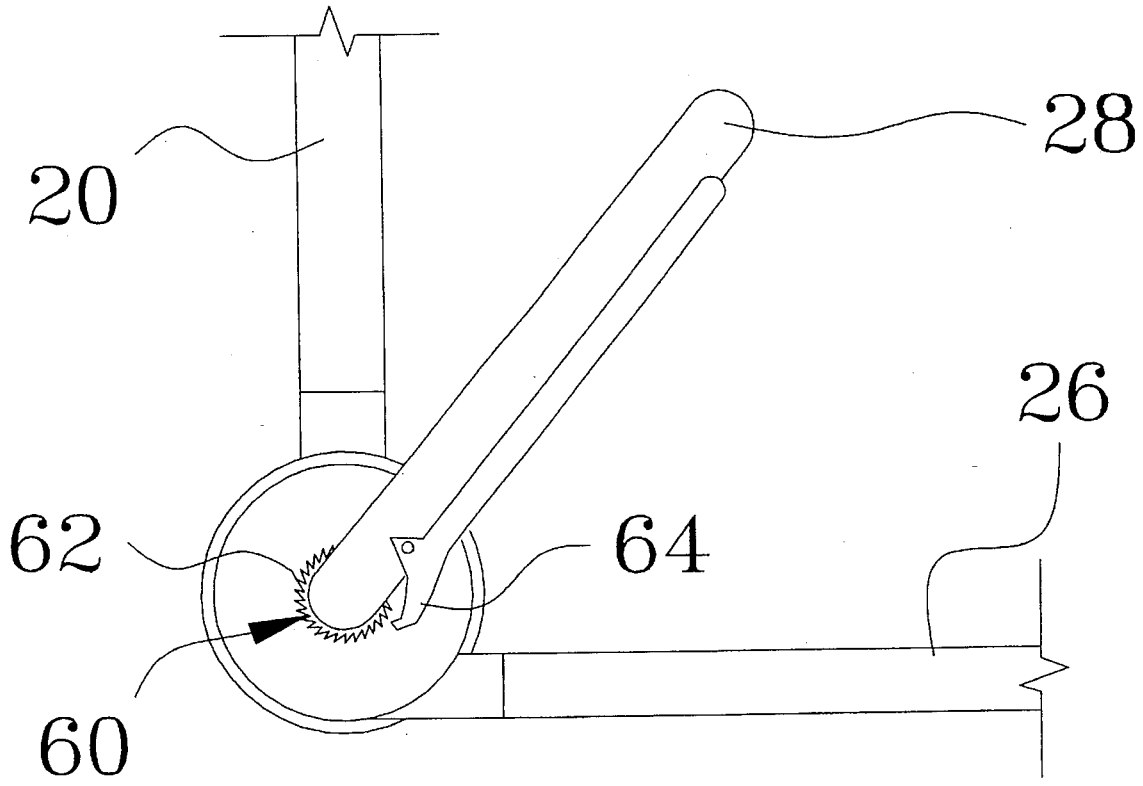
Figure 6C:
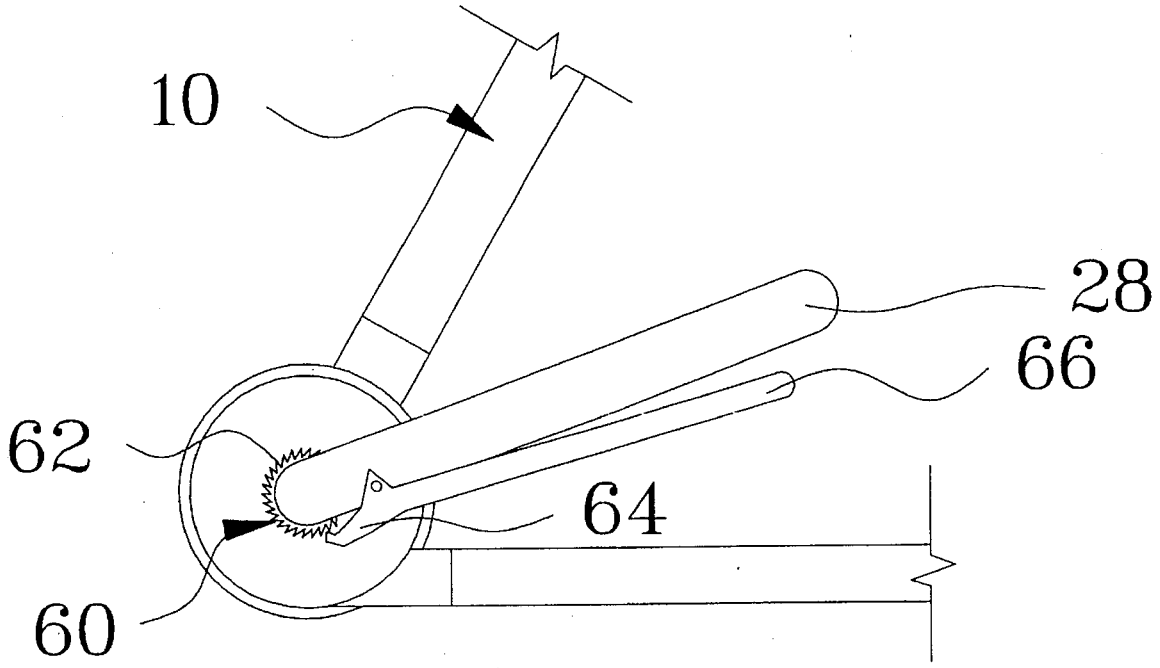

FIGS. 6(*a*)–6(*b*) show the operation of position locking means 60 for locking a position of the first contacting member 10 relative to the position of the second contacting member relative 16. The position locking means 60 includes a toothed wheel 62 that is rotatable by the first contacting member 10 when the first contacting member 10 pivots. A pawl 64 pivoted by a user-operated arm 66 engages with the toothed wheel 62, so that in an engaged position, the first contacting member 10 is pivotable only in a direction allowing the chest 34 to be urged toward the legs 18. The pawl 64 is operably disengaged from the toothed wheel 62 by the user 14, so that the first continuing member 10 is pivotable in an opposite direction, allowing the chest 34 to move away from the legs 18. Thus, as shown in FIG. 6(*b*), when the user operates the arm 66 to pivot the pawl 64 away from the toothed wheel 62, the first contacting member 10 can be moved in either direction, without being locked by the engagement of the pawl 64 with the toothed wheel 62. However, as shown in FIG. 6(*c*) when the pawl 64 is engaged with the toothed wheel 62, the engagement allows the first contacting member 10 to move only in the direction that allows the chest 34 to be urged toward the legs 18 so that the stretched muscles can be maintained in their stretched position, and, as the user relaxes in the thus held stretching position, the muscles being stretched loosen up.

Figure 7:
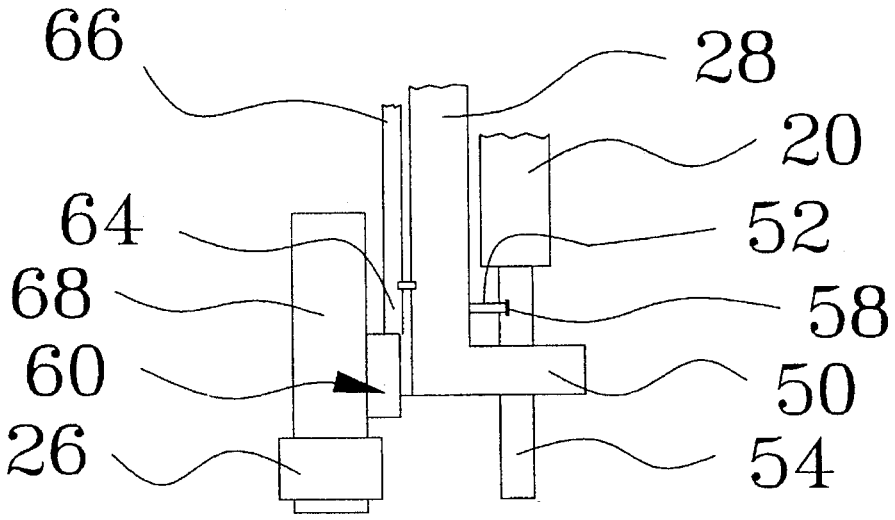
FIG. 7 is a cross sectional side view and corresponding front view showing the positional relationships of various essential components of the inventive fitness device.
Figure 7:
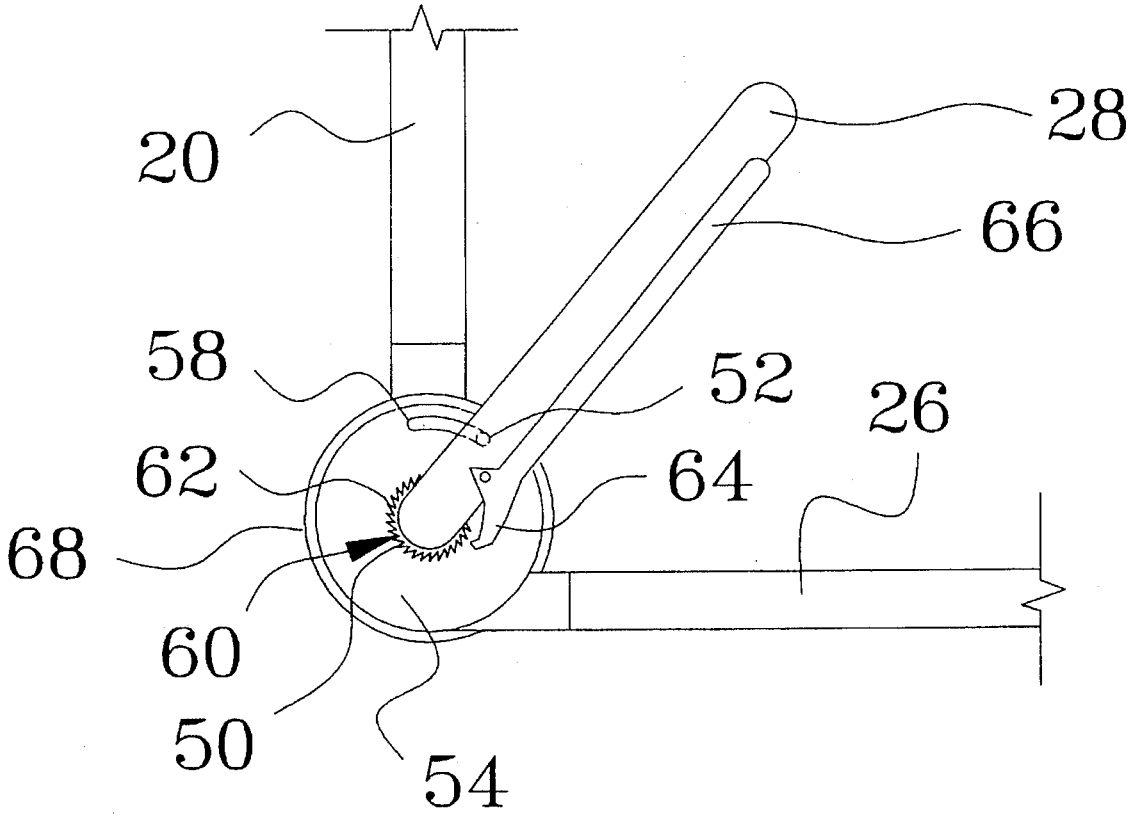

FIG. 7 shows the relationship of the constituent parts of the inventive fitness device. The seat frame 26 is fixed to a cover plate 68, which in turn is fixed with the toothed wheel 62. The arm 66 is pivotally supported by the lever 28, for selectively engaging and disengaging the pawl 64 with the toothed wheel 62. The back frame 20 is fixed to the driving member 54 which is rotatably supported on the axle 50. The driving member 54 has the receiving groove 58 that receives the protruding member 52 fixed to the lever 28. Thus, as the lever 28 is urged forward, the driving member 54 rotates around the axle 50, and causes the back frame 20 to pivot.

Figure 8:
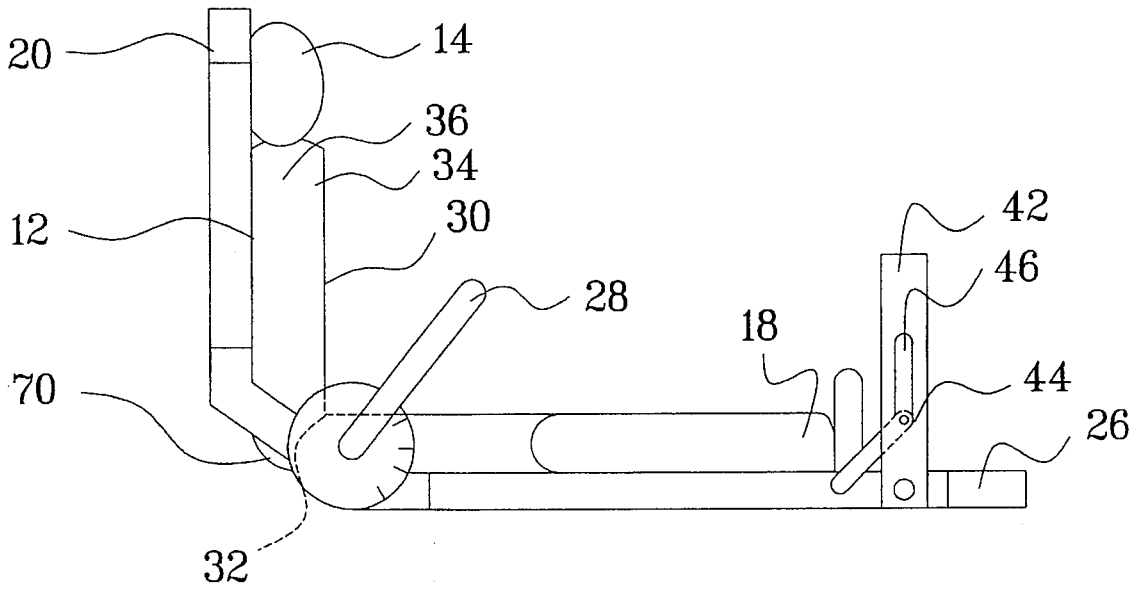
FIG. 8 is a side view of another embodiment of a fitness device in accordance with the present invention.

FIG. 8 shows an alternative embodiment of the inventive fitness device. In this embodiment, the back frame 20 is offset from the pivotable connection with the seat frame 26, as compared with the other embodiments. The offsetting of the backframe 20 accommodates the buttocks 70 of the user 14 to allow easier bending of the torso 30 at the waist 32, when performing the stretching exercises utilizing the inventive fitness device.

Figure 9A:
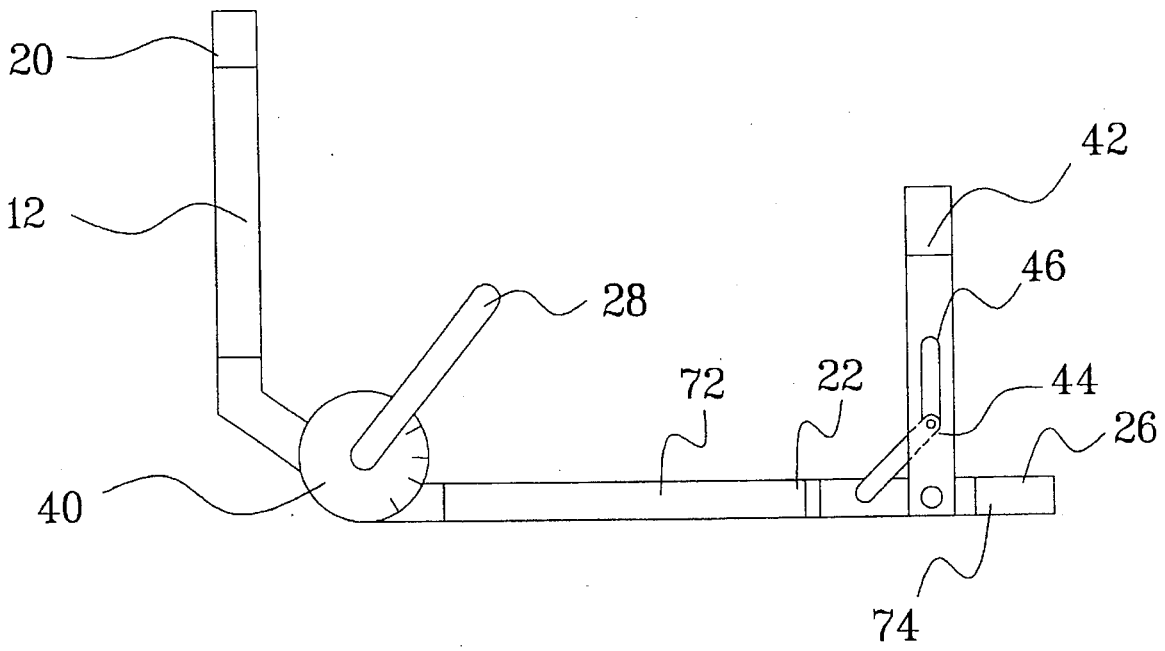
FIG. 9(*a*) is a side view of yet another embodiment of a fitness device in accordance with the present invention.
Figure 9B:
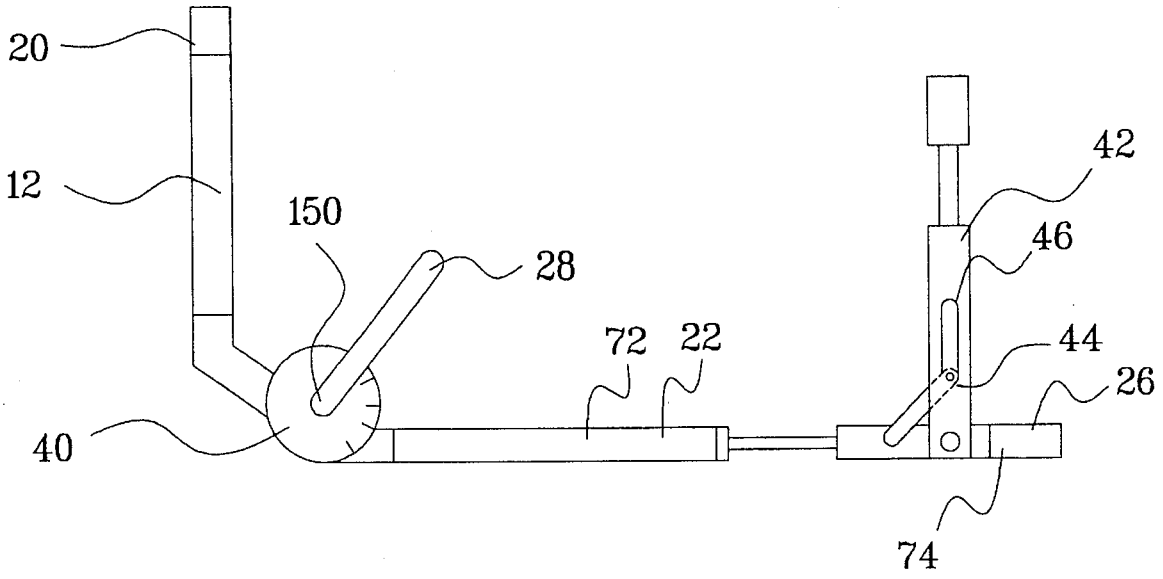

FIGS. 9(*a*) and 9(*b*) show another alternative embodiment of the inventive fitness device. In this embodiment, the seat frame 26 is separated into two telescoping sections, one section 72 supporting the contacting surface 22 supported on the seat frame 26, and the other section 74 supporting the bar member 42. As shown in FIG. 9(*b*), the bar member 42 is positionable at a variable distance from the pivotable connecting means (axle 150) by extending the telescoping seat frame 26, so as to accommodate users of different fitness levels and height. Also, as shown in FIGS. 9(*a*) and 9(*b*), the top of the bar member 42 can be extended in a telescoping manner to increase the height of the bar member 42, further adding to the versatility of inventive fitness device.

Figure 10A:
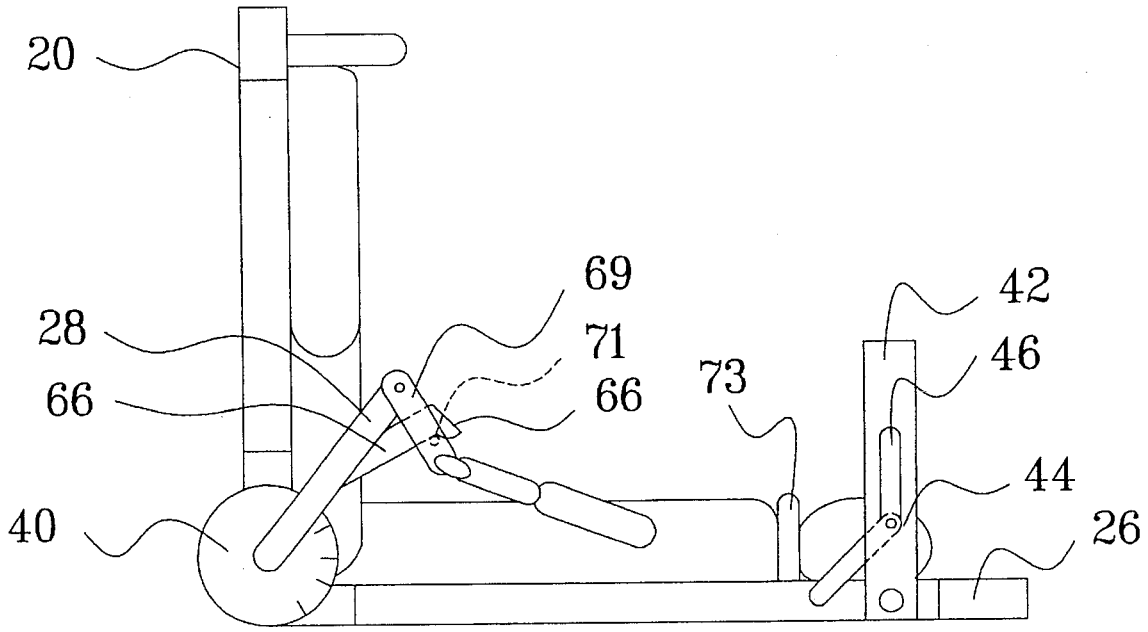
FIG. 10(*a*) is a side view of an alternative configuration of the inventive fitness device during another alternative method of use.
Figure 10B:
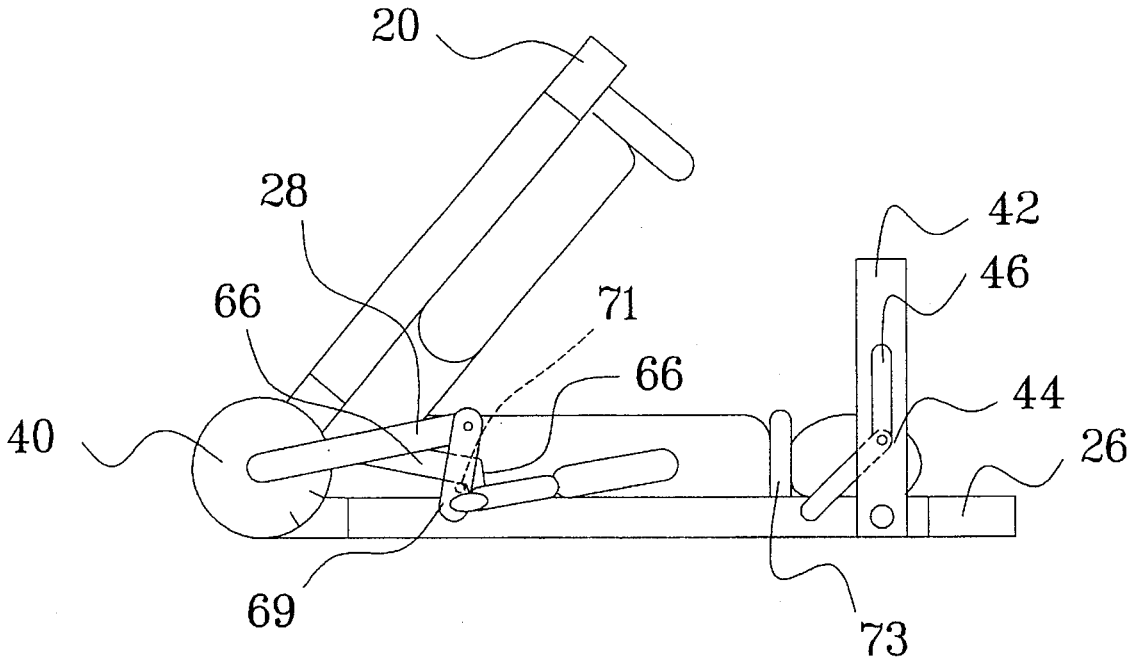
Figure 10C:
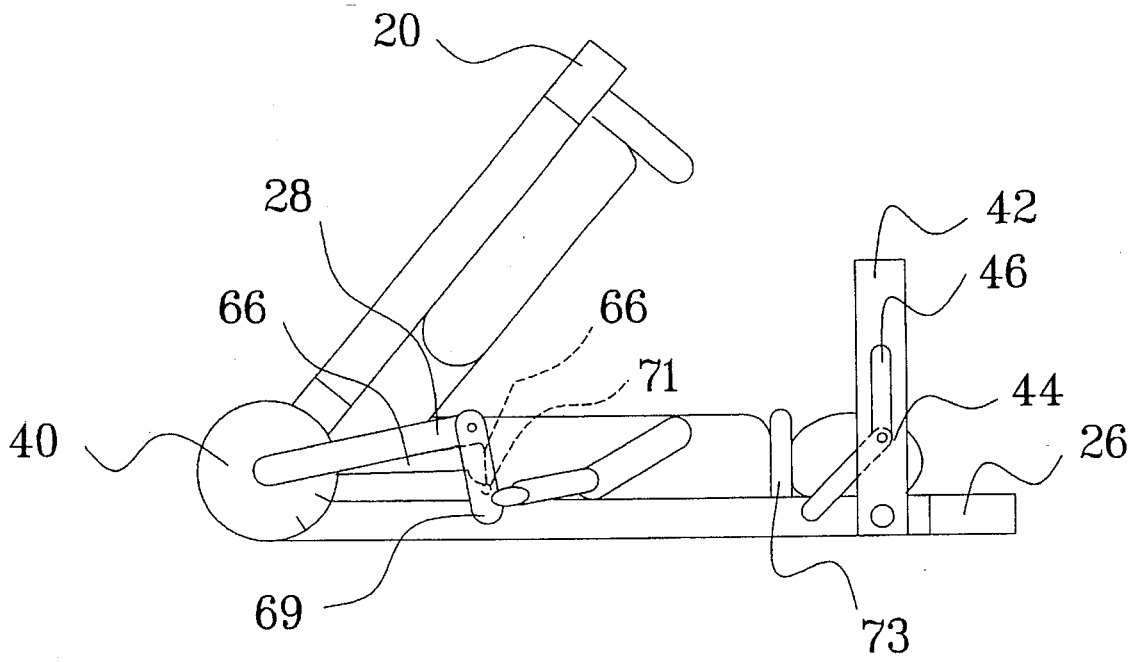
Figure 11A:
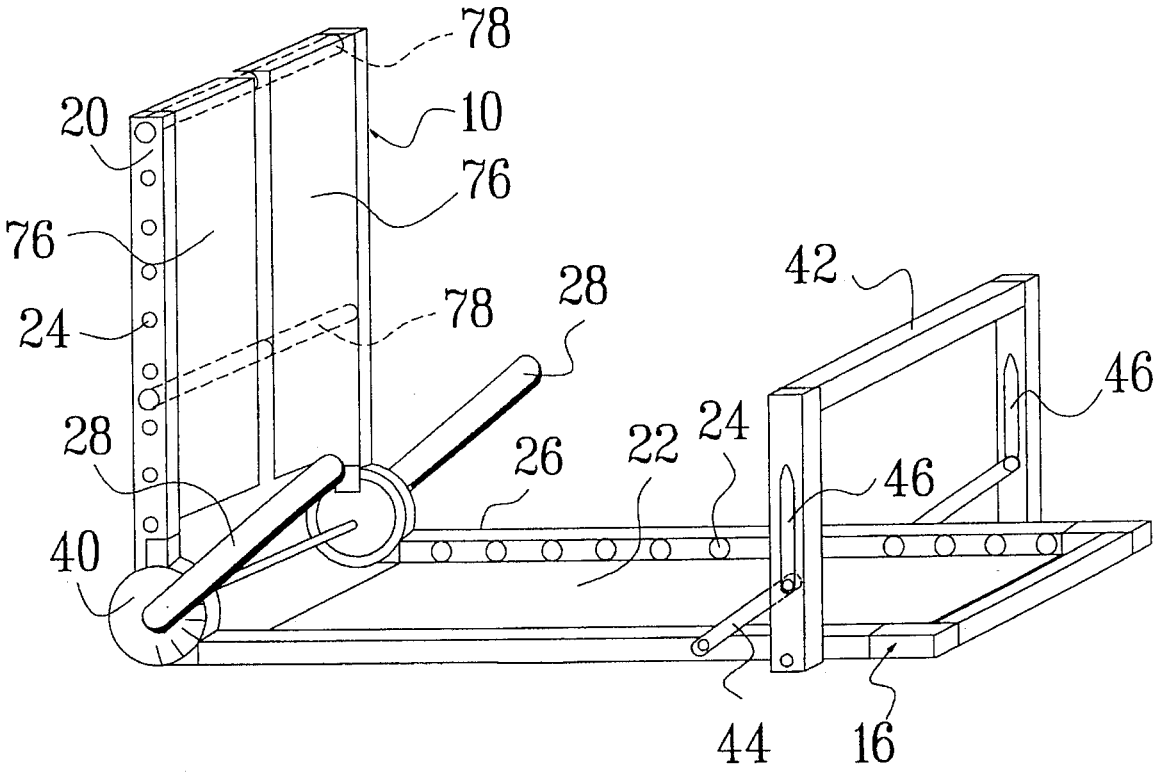
FIG. 11(*a*) is a perspective view of another embodiment of the fitness device in accordance with the present invention.
Figure 11B:
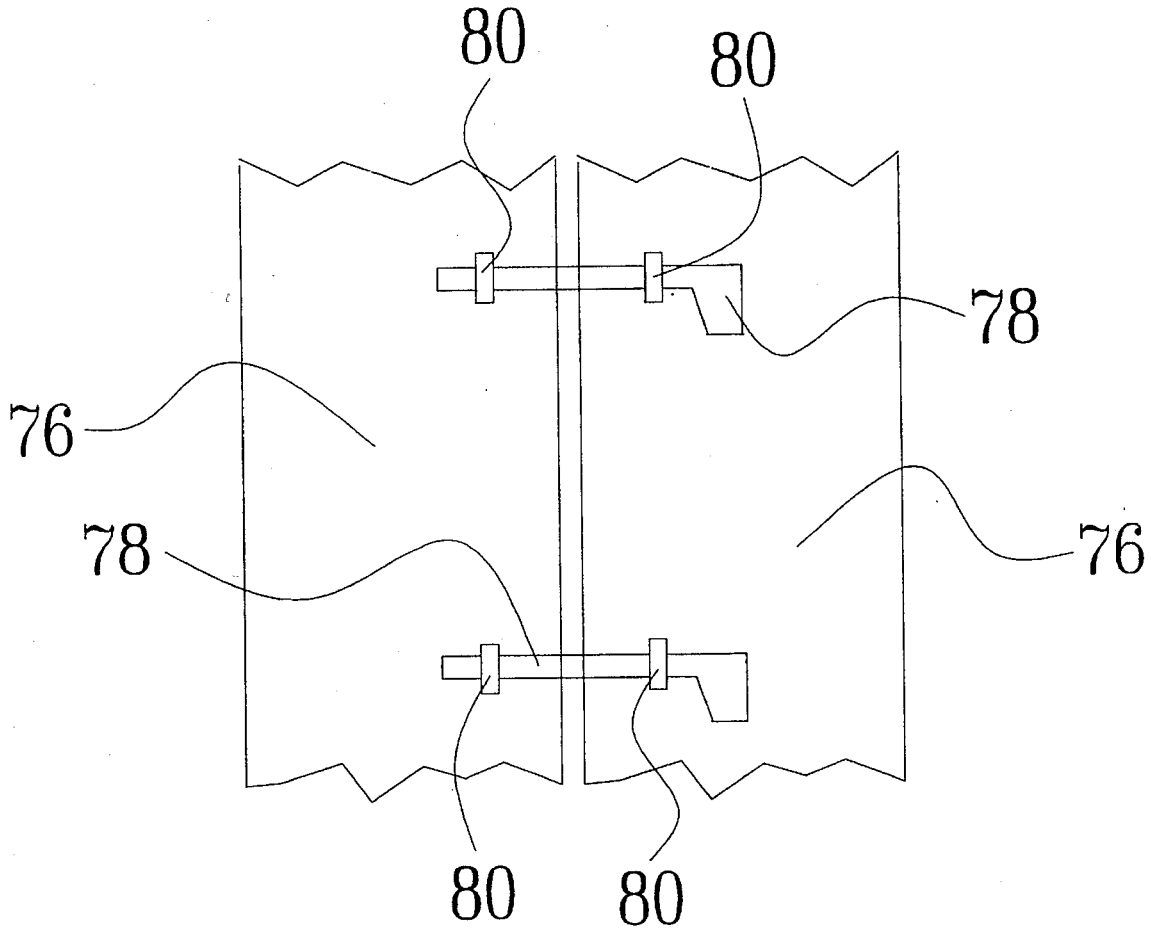
Figure 11C:
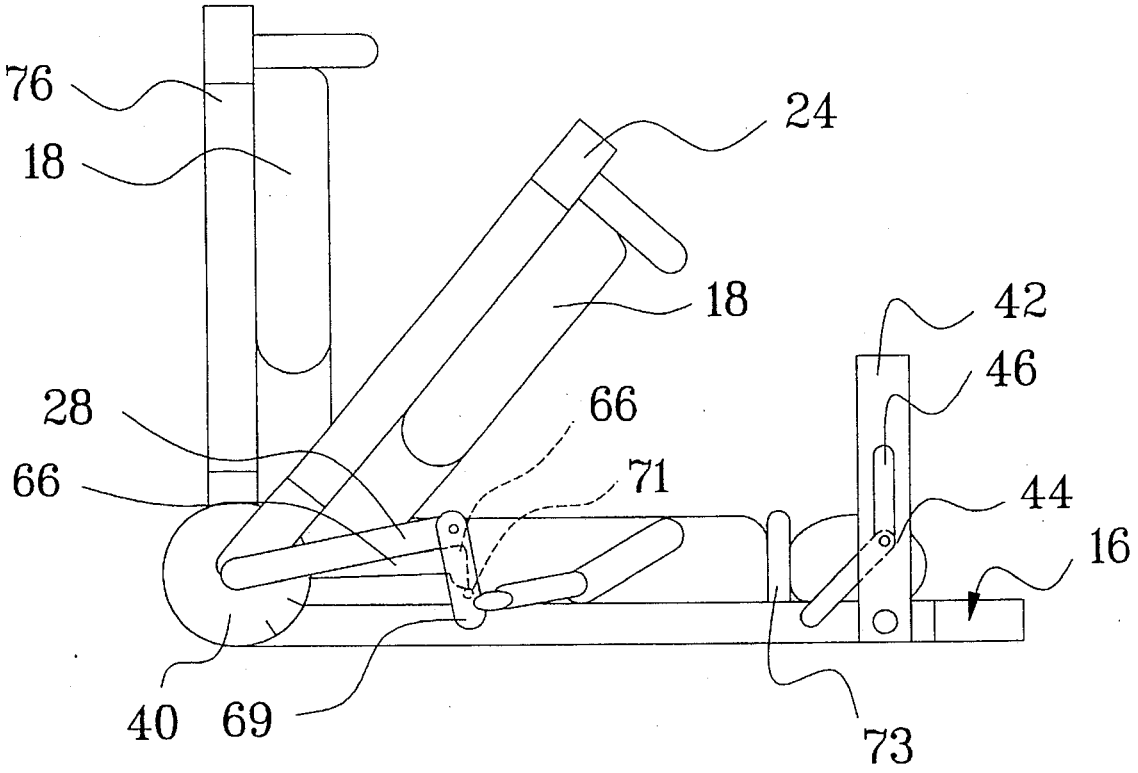
Figure 11D:
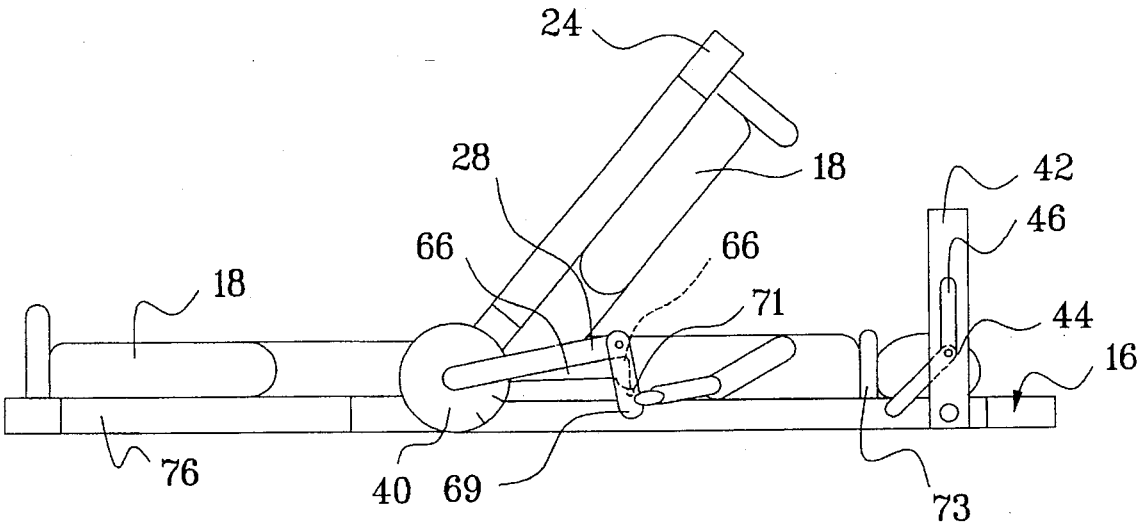

FIGS. 10(*a*)–10(*c*) show an alternative configuration of the inventive fitness device and an alternative use. In accordance with the use of this configuration, the user 14 has the option of laying on his back and using the inventive fitness device to urge his legs 18 toward his chest 34. To enable the user to operate the lever 28 when in the position shown in FIG. 10(*a*), an extended lever arm 69 is provided. As shown in FIG. 10(*b*), by pulling on the extended lever arm 69, the lever 28 is operated and the legs 18 of the user 14 are urged toward his chest 34, thereby effectively stretching the muscles of the user 14. To release the locking means 60 (shown in FIGS. 6(*a*)–6(*b*)), the user operated arm 66 includes a release surface which is urged by a roller 71 fixed to the extended lever arm 69. Thus, as shown in FIG. 10(*c*), by pivoting the extended lever arm 69 relative to the lever 28, the user 13 is able to release the locking means 60. Furthermore, pads 73 may be provided for maintaining the position of the shoulders of the user 14 (or the legs 18 when the user 14 takes the position shown in FIGS. 10(*a*)–(*c*)). The position pads 73 are adjustable to accommodate users of different height.

FIGS. 11(*a*) through 11(*d*) show another embodiment of the inventive fitness device. In this embodiment, the contacting surfaces that contact with the legs 18 of the user are split so that each leg 18 can move independent of the other. In this embodiment, each split contacting surface 76 is urged by a respective lever 28. Thus, in accordance with this embodiment of the inventive exercise device, the user is able to stretch each leg 18 separately and independently, so as to effectively stretch specific muscle groups of the legs and lower back. As shown in FIG. 11(*a*), the two split contacting surfaces 76 may be fixed together, using, for example, pins 78, or other fastening devices, so that the pair of split contacting surfaces 76 move in unison, and act as the single contacting surface 22 shown in the other embodiments.

FIG. 11(*b*) shows an isolated view of the backs of the split contacting surfaces 76, showing an alternative configuration of the pins 78. In this case, the pins 78 slide into and are held by receiving structures 80 disposed at the back of each of the split contacting surfaces 76. The pins 78 may comprise any suitable material, such as metal, wood, plastic or the like. Preferably, bent steel rods are used as the pins 78, so as to enhance the durability of the fitness device, and to provide a rigid connection between the pair of split contacting surfaces 76.

FIG. 11(*c*) shows this embodiment of the inventive fitness device in use. In this case, the user 14 lies on his back, and starts the stretching exercise with both legs raised to a suitable angle and held in position by each respective split contacting surface 76. As shown, while one leg 18 is being urged through the action of the lever 28, the other leg is held in a stationary raised position, for example, using the locking mechanism described with reference to FIGS. 6(*a*) through 6(*c*). The stationary leg 18 may be disposed and held at any angle relative to the floor through the use of the locking components. Further, as shown in FIG. 11(*d*), one leg 18 may be disposed at a substantially horizontal position, while the other leg 18 is urged by its respective split contacting surface 76, so as to provide adequate stretching to the muscle groups of the legs and lower back.

INDUSTRIAL APPLICABILITY

The present invention is particularly suitable for application to modern industrial processes. In particular, the present invention is constructed of common materials, such as aluminum tubing, and can be easily manufactured using conventional techniques, such as metal bending. The inventive fitness device may be constructed of a less durable, more light weigh materials, such as utilizing a lighter thinner gage of aluminum tubing for the frame, and a thinner plywood substrate for the contacting surfaces. This construction may be suitable for home use. On the other hand, a more robust construction, suitable for commercial fitness club use may utilize, for example heavier gage steel or aluminum tubing for the frame, and a thicker plywood substrate for the contacting surfaces. Similarly, the other components of the inventive fitness device may be selectively chosen depending on the intended use, and the durability, compactness and weight considerations thereof.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A fitness device for use by a user having a back, legs, a torso, a waist and a chest, comprising:

a) a first contacting member for contacting at least a portion of the user's back, said first contacting member defining a first plane;

b) a second contacting member for contacting at least a portion of the legs of the user, said second contacting member defining a second plane relative to said first plane;

c) a pivotable connecting member for connecting said first contacting member with said second contacting member so that said first contacting member is pivotable relative to said second contacting member, said pivotable connecting member defining an axis; and d) a lever pivotable about said axis and fixed to said first contacting member, said lever being positionable outside of said first and second planes, and operable by the user for engaging and urging said first contacting member against the back of the user, driving the back of the user in an angular direction towards his legs.

2. A fitness device according to claim 1, wherein said first contacting member comprises a first planar member having an end fixed to said pivotable connecting member; and said second contacting member comprises a second planar member having an end fixed to said pivotable connecting member so that in an initial position said first contacting member and said second contacting member define a first angle for accommodating the user disposed so as to have the user's back contacting said first planar member and his legs contacting said second planar member with the user's torso and his legs defining substantially said first angle; and said urging member comprises a lever operable by the user for urging said first planar member to pivot relative to said second planar member to define a second angle wherein said first planar member is adapted to apply pressure to the user's back to urge his chest toward his legs.

3. A fitness device according to claim 1, wherein said pivotable connecting member includes an axle rotatable by said lever and engageable with said first planar member so that a user exerted force on said lever is operable for pivoting said first planar member to apply pressure to the user's back to urge his chest toward his legs.

4. A fitness device according to claim 1, further comprising a bar member extending from the second planar member for being pulled by the arms of the user to urge his chest toward his legs.

5. A fitness device according to claim 4, wherein said bar member is positionable at a variable distance from the pivotable connecting member.

6. A fitness device according to claim 1, further comprising position locking means for locking a position of said first contacting member relative to said second contacting member.

7. A fitness device according to claim 6, wherein said position locking means comprises a toothed wheel rotatable by said first contacting member when said first contacting member pivots, and a pawl for engaging with said toothed wheel so that in an engaged position said first contacting member is pivotable only in a direction allowing the user's chest to be urged towards his legs, said pawl being operably disengageable from said toothed wheel by the user so that said first contacting member is pivotable in an opposite direction allowing the user's chest to move away from his legs.

8. A fitness device according to claim 1, wherein said lever is pivotable about an axis and having a protruding member, and a driving member fixed with said first contacting member and rotatable about said axis, said driving member having a driving surface and defining a receiving groove for receiving said protruding member and terminating at said driving surface, said lever being operable by the user for moving said protruding member against said driving surface to rotate said driving member about said axis for urging said first contacting member to pivot relative to said second contacting member so as to urge the user's chest toward his legs, said groove being dimensioned to allow said driving surface to rotate a predetermined amount without said lever being pivoted.

9. A fitness device according to claim 1, further comprising a bar member extending from the second planar member for being pulled by the user's arms to urge his chest toward his legs.

10. A fitness device according to claim 9, wherein said bar member is positionable at a variable distance from the pivotable connecting member.

11. A fitness device for use by a user having a back, legs, a torso, a waist and a chest, comprising:

a) a first contacting member having an end and for contacting at least a portion of the user's back;

b) a second planar member having an end and for contacting at least a portion of the user's legs;

c) a pivotable connecting member for connecting said first contacting member with said second contacting member so that said first contacting member is pivotable relative to said second contacting member; and d) a lever pivotable about an axis and having a protruding member, and a driving member fixed with said first contacting member and rotatable about said axis, said driving member having a driving surface and defining a receiving groove for receiving said protruding member and terminating at said driving surface, said lever being operable by the user for moving said protruding member against said driving surface to rotate said driving member about said axis for urging said first contacting member to pivot relative to said second contacting member so as to urge the user's chest toward his legs, said groove being dimensioned to allow said driving surface to rotate a predetermined amount without said lever being pivoted.

12. A fitness device according to claim 11, wherein said pivotable connecting member includes an axle rotatable by said lever and engagable with said first planar member so that a user exerted force on said lever is operable for pivoting said first planar member to apply pressure to the user's back to urge his chest toward his legs.

13. A fitness device according to claim 11, further comprising a bar member extending form the second planar member for being pulled by the arms a user to urge his chest toward his legs.

14. A fitness device according to claim 13, wherein said bar member is positionable at a variable distance from the pivotable connecting member.

15. A fitness device according to claim 11, further comprising position locking means for locking a position of said first contacting member relative to said second contacting member.

16. A fitness device according to claim 15, wherein said position locking means comprises a toothed wheel rotatable by said first contacting member when said first contacting member pivots, and a pawl for engaging with said toothed wheel so that in an engaged position said first contacting member is pivotable only in a direction allowing the user's chest to be urged toward his legs, said pawl being operably disengagable from said toothed wheel by the user so that said first contacting member is pivotable in an opposite direction allowing the user's chest to move away from his legs.

17. A fitness device according to claim 11, wherein said pivotable connecting member includes an axle rotatable by said lever and engageable with said first planar member so that a user exerted force on said lever is operable for pivoting said first planar member to apply pressure to the user's back to urge his chest toward his legs.

18. A fitness device for use by a user having a back, legs, a torso, a waist and a chest, comprising;

a) a first contacting member having an end for contacting at least a portion of the user's back;

b) a second contacting member having an end for contacting at least a portion of the user's legs;

c) a pivotable connecting member fixed to the end of the first contacting member and the end of the second contacting member for pivotally connecting said first contacting member with said second contacting member so that said first contacting member is pivotable relative to said second contacting member so that in an initial position said first contacting member and said second contacting member define a first angle for accommodating the user disposed so as to have the user's back contacting said first contacting member and the user's legs contacting said second contacting member with the user's torso and legs defining substantially said first angle;

d) an urging member comprising a lever operable by the user for urging said first contacting member to pivot relative to said second contacting member to define a second angle wherein said first contacting member applies pressure to the user's back to urge the user's chest toward his legs so that the user's torso or the user bends at the waist of the user and the chest of the user is urged towards the legs of the user;

e) a position locking means for locking a position of said first contacting member relative to said second contacting member; and f) a bar member extending from the second contacting member for being pulled by the arms of the user to urge the user's chest toward the user's legs.

19. A fitness device according to claim 18, wherein said bar member is positionable at a variable distance form the pivotable connecting member.

20. A fitness device according to claim 18, wherein said position locking means comprises a toothed wheel rotatable by said first contacting member when said first contacting ember pivots, and a pawl for engaging with said toothed wheel so that in an engaged position said first contacting member is pivotable only in a direction allowing the user's chest to be urged towards his legs, said pawl being operably disengageable from said toothed wheel by the user so that said first contacting member is pivotable in an opposite direction allowing the user's chest to move away from his legs.

21. A fitness device according to claim 18; wherein said urging member comprises said lever being pivotable about an axis and having a protruding member, and a driving member fixed with said first contacting member and rotatable about said axis, said driving member having a driving surface and defining a receiving groove for receiving said protruding member and terminating a to said driving surface, said lever being operable by the user for moving said protruding member against said driving surface to rotate said driving member about said axis for urging said first contacting member to pivot relative to said second contacting member so as to urge the user's chest toward his legs, said groove being dimensioned to allow said driving surface to rotate a predetermined amount without said lever being pivoted.

* * * * *